United States Patent [19]

Katterhenry et al.

[11] Patent Number: 4,912,942

[45] Date of Patent: Apr. 3, 1990

[54] REFRIGERATOR CABINET AND DOOR CONSTRUCTION

[75] Inventors: Glenn E. Katterhenry; Raymond G. Simons, both of Evansville; John P. Keil, Ohio Township, Warrick County, all of Ind.

[73] Assignee: Whirlpool Corporation, Benton Harbor, Mich.

[21] Appl. No.: 312,722

[22] Filed: Feb. 21, 1989

[51] Int. Cl.[4] ..... F25D 23/12

[52] U.S. Cl. ..... 62/338; 403/71; 403/80; 439/194; 439/446

[58] Field of Search ..... 62/338, 339, 389; 403/80, 69–71; 285/161, 206, 272; 439/194, 204, 208, 261, 367, 446

[56] References Cited

U.S. PATENT DOCUMENTS

| | | | |
|---|---|---|---|
| 463,068 | 11/1891 | Moore et al. | 285/272 X |
| 2,286,566 | 6/1942 | Norton | 285/272 X |
| 2,313,557 | 3/1943 | Krenke | 285/272 X |
| 2,354,272 | 7/1944 | Miller et al. | 62/89 |
| 2,382,135 | 8/1945 | Crew | 285/272 |
| 2,530,540 | 11/1950 | Reichold et al. | 439/446 X |
| 2,571,379 | 10/1951 | Parsons | 285/272 X |
| 2,786,338 | 3/1957 | Wurtz et al. | 62/89 |
| 2,949,625 | 8/1960 | Guyer | 403/80 X |
| 3,042,780 | 7/1962 | Gursaheney | 219/19 |
| 3,332,433 | 7/1967 | Edmonson | 285/161 X |
| 3,429,140 | 2/1969 | White | 62/339 |
| 3,788,094 | 1/1974 | Benasutti et al. | 62/339 |
| 4,036,620 | 7/1977 | Benasutti et al. | 62/338 |
| 4,097,096 | 6/1978 | Kochendorfer | 312/214 |
| 4,186,945 | 2/1980 | Hahn | 285/19 |
| 4,293,151 | 10/1981 | Manzel | 285/161 |
| 4,543,800 | 10/1985 | Mawby et al. | 62/339 |

*Primary Examiner*—William E. Tapolcai

*Attorney, Agent, or Firm*—Wood, Phillips, Mason, Recktenwald & VanSanten

[57] ABSTRACT

A rigid crossover tube is provided to bridge from a refrigerator door to a refrigerator cabinet and to serve as a guide and protective cover for a water and/or electrical conductors connected to a door mounted ice and water dispensing apparatus. A fitting is provided in the bottom surface of the door. The tube is held in the fitting and is permitted to pivot relative thereto. The tube enters the cabinet through an opening in the base of the cabinet and is slidable therein responsive to pivotal movement of the tube when the door is opened or closed.

14 Claims, 2 Drawing Sheets

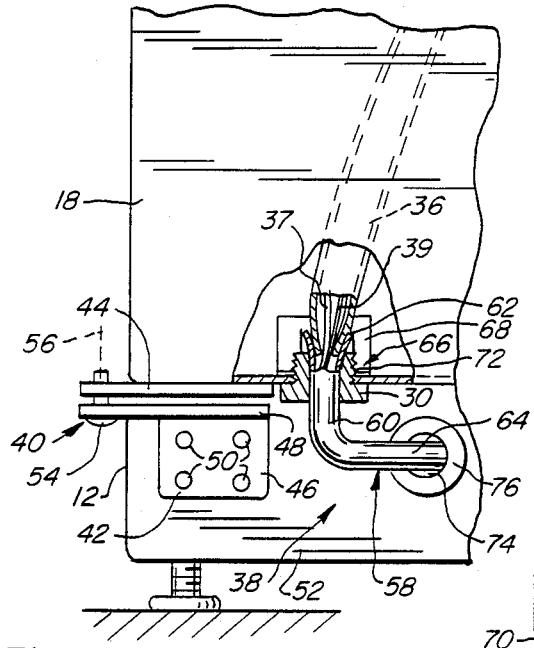
FIG. 4
FIG. 5
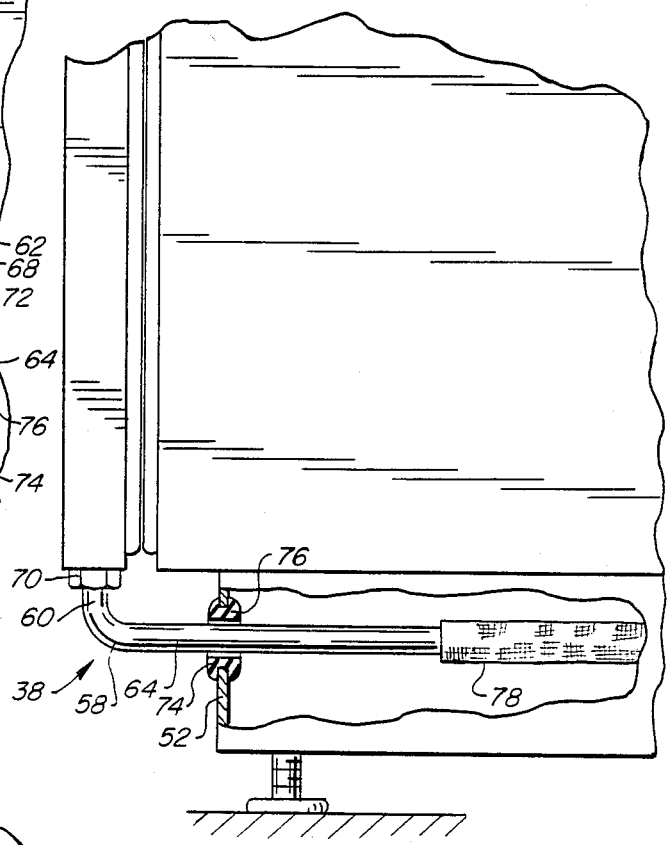
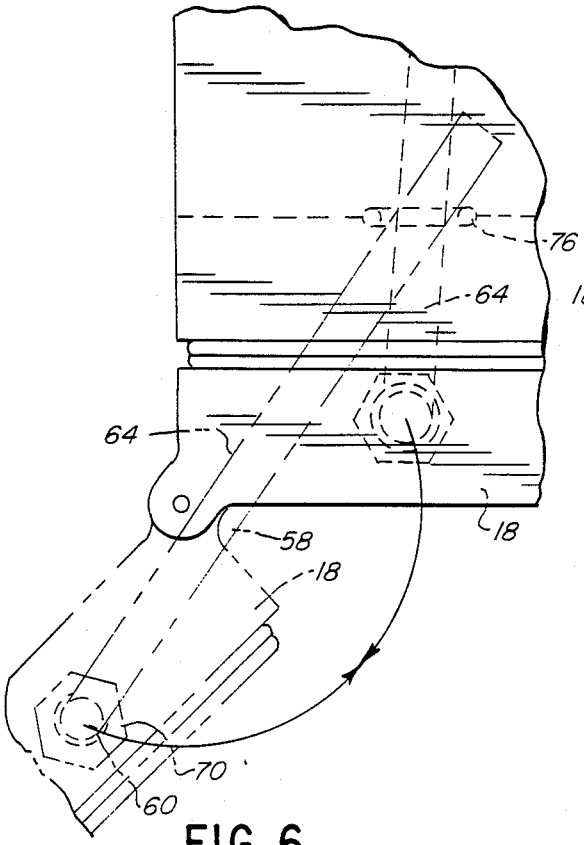
FIG. 6
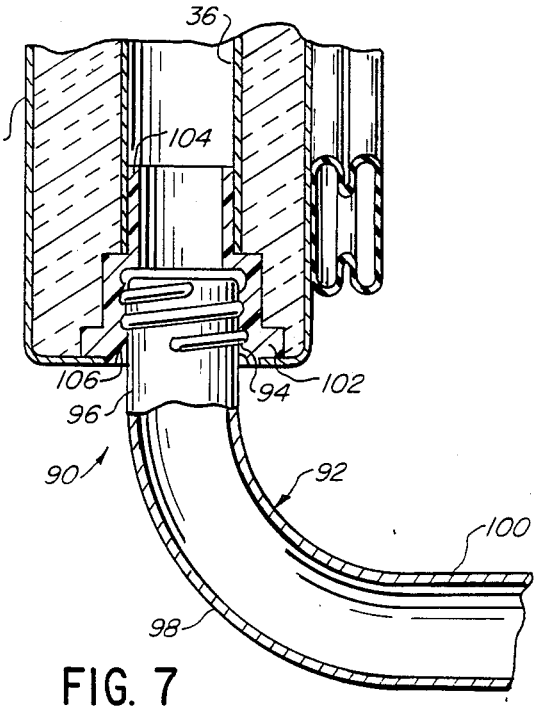
FIG. 7

REFRIGERATOR CABINET AND DOOR CONSTRUCTION

BACKGROUND OF THE INVENTION

1. Field of the Invention

This invention relates generally to a refrigeration apparatus, and more particularly, to an improved refrigerator cabinet and door construction.

2. Description of Background Art

Refrigerators typically include a cabinet having an internal storage space which is accessible through an access opening. The cabinet includes a door hingedly mounted thereto for selectively closing the access opening. Often it is desirable to include an ice and water dispenser on the cabinet door which is user accessible without opening the door. Typically, this dispenser is positioned on a freezer cabinet door so that an ice making apparatus is directly adjacent thereto for providing direct release of ice bodies therefrom. It is also necessary to provide connection to a source of pressurized water and suitable electrical connections for operating the same.

Since it is necessary to maintain the water connections below the freezing temperature, the water conduit cannot pass through the freezer compartment. Instead, it is necessary that the conduit travel from the refrigerator cabinet and into the cabinet door where it is suitably insulated from the freezer compartment. However, problems result from the necessity of the conduit and electrical wires crossing over from the door to the cabinet.

Wurtz et al. U.S. Pat. No. 2,786,338 discloses a refrigerating apparatus which includes a flexible tube extending between the refrigerator cabinet and the door and having a looped portion of such length to permit the door to be swung about its hinged mountings. A sleeve is secured to the door and receives a portion of the flexible tubing for protecting the same while the door is in the open position.

Other patents, see, for example Mawby et al. U.S. Pat. No. 4,543,800 and White U.S. Pat. No. 3,429,140, disclose a refrigerator which includes a conduit which passes through the door hinge. In the White patent the conduit extends from the hinge into the front wall of the cabinet. In the Mawby et al. patent the water conduit and electrical conductors pass directly from the conduit into the front wall of the cabinet, and the conduits are protected by a cover member and kick plates.

These latter refrigerators, while being suitable in certain applications are only useful if the cabinet door includes a pivot axis which lies within the body of the door.

The present invention is intended to overcome one or more of the problems as set forth above, in a novel and simple manner.

SUMMARY OF THE INVENTION

In accordance with the invention, a refrigeration apparatus is provided with a crossover tube pivotally mounted to a cabinet door to enclose a conduit extending between the door and a refrigerator cabinet.

Broadly, there is disclosed herein a refrigeration apparatus having a cabinet housing a utility source apparatus and a door hingedly mounted to the cabinet. The door has a utility utilization apparatus. Means are included for operatively connecting the utilization apparatus to the source apparatus. An improvement is provided in the form of means pivotally mounted to the door and extending through an opening in the cabinet for routing the connecting means from the door to the cabinet.

According to the disclosed embodiment of the invention, the utility utilization apparatus comprises an ice and water dispensing apparatus.

Specifically, according to the disclosed embodiment, a rigid tube is provided to bridge from the refrigerator door to the cabinet and to serve as a guide and protective cover for a water and/or electrical conductors connecting the dispensing apparatus to a water source and electrical controls, all housed in the cabinet. A fitting is provided in the bottom surface of the door. The tube is held in the fitting and is permitted to pivot relative thereto. The tube enters the cabinet through an opening in the base of the cabinet. The tube is shaped to enter the cabinet at the desired location and is sufficiently long to ensure that it is not pulled out of the opening when the door is at any of its normal functioning positions.

It is a feature of the invention that the cabinet includes a grommet about the opening permitting the rigid tube to slide in and out of the refrigerator cabinet as the door is opened or closed.

It is another feature of the invention that the inner end of the rigid tube is provided with a braided jacket which extends over a slack loop portion of the water and electrical conductors to protect the lines as they move with the door.

According to one embodiment of the invention, the fitting comprises a retaining nut which engages a flanged end of the crossover tube to retain the same in pivotal relationship with the door.

According to another embodiment of the invention, the fitting comprises a threaded nut which accepts external threads on the crossover tube.

According this other embodiment of the invention, the opening and closing of the door tightens and untightens the screw threads, respectively, between the crossover tube and the retaining nut. The amount of the rotation incurred is not enough to allow the tube to tighten completely or to loosen and dislodge.

Further features and advantages of the invention will readily be apparent from the specification and from the drawings.

BRIEF DESCRIPTION OF THE DRAWINGS

FIG. 4 is a detailed, partially cut away, view of the crossover tube assembly according to a first embodiment of the present invention;

FIG. 5 is a partially cut away side view of the crossover tube assembly of FIG. 4;

FIG. 6 is a schematic diagram illustrating the operation of the crossover tube assembly of FIGS. 4 and 5; and FIG. 7 is a detailed, partially cut away view of a crossover tube assembly according to a second embodiment of the invention.

DETAILED DESCRIPTION OF THE INVENTION

Figure 1:
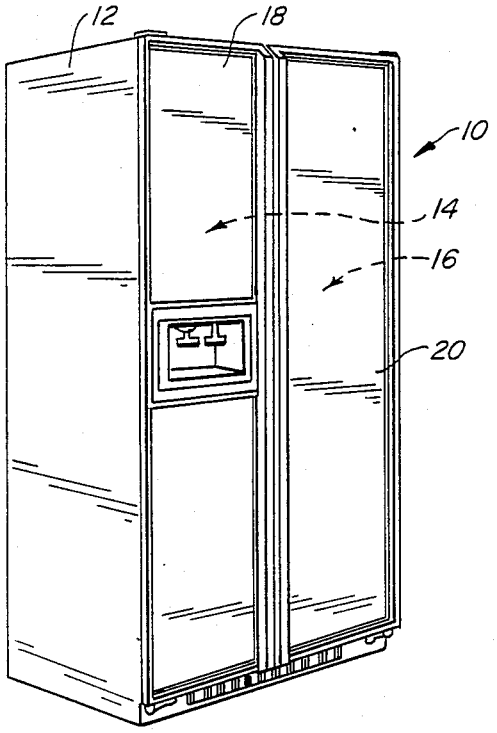
FIG. 1 is a perspective view of a refrigerator embodying the invention.

Referring to FIG. 1, a refrigeration apparatus, such as a refrigerator/freezer 10, includes a cabinet and door construction utilizing a crossover tube assembly according to the present invention. The invention is shown utilized with a built-in, side-by-side refrigerator/freezer; however, other types of refrigeration apparatus may be used in conjunction with the construction of the present invention, as will be obvious to those skilled in the art.

The refrigerator/freezer 10 includes a cabinet 12 provided with an internal liner and an insulating separator or divider wall (not shown) to define a below-freezing, or freezer, compartment 14 and a fresh food, or above-freezing, compartment 16. Each of the compartments 16 and 18 comprises a storage space as is well known.

The freezer compartment 16 is accessible through an access opening (not shown). A freezer door 18 is provided for selectively closing the freezer compartment access opening. Similarly, the fresh food compartment 16 includes an access opening (not shown) and a fresh food door 20 is provided for selectively closing the fresh food compartment access opening.

Figure 2:
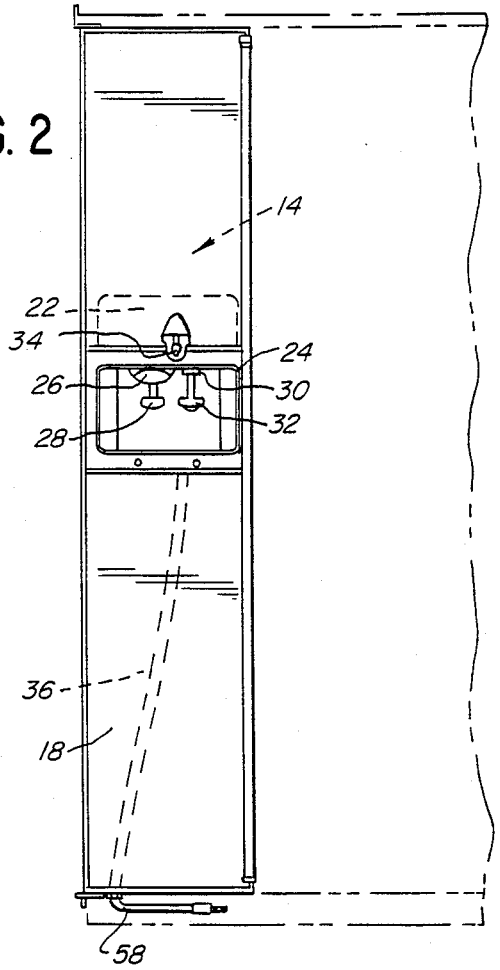
FIG. 2 is a front elevational view of a freezer compartment door for the refrigerator of FIG. 1, with the refrigerator cabinet being illustrated in dashed lines.

Referring also to FIG. 2, a conventional ice making apparatus 22 is installed in the freezer compartment 14 for forming ice bodies. The ice bodies may be removed in a conventional manner as by opening the freezer door 18, or through an ice and water dispensing apparatus 24 mounted to the door 18 and accessible with the door 18 in the closed position, as is well known.

The dispensing apparatus 24 includes a chute 26 which is aligned with the ice making apparatus 22. The dispensing apparatus 24 is operable to cause the ice making apparatus 22 to dispense ice bodies into the chute 26 upon actuation of a first lever 28. A water dispenser 30 is provided for dispensing water upon actuation of a second lever 32. A light bulb 34 provides illumination of the dispensing apparatus 24.

As is well known, the chute 26 is positioned, when the door is closed, below a dispenser for the ice making apparatus 22. A water supply for the water dispenser 30 comprises any source of pressurized and, advantageously, refrigerated water which is housed in the cabinet 12 and may be connected in a known manner to a domestic water utility supply. The light 34 and any necessary control circuits for the dispensing apparatus 24 may also be housed in the cabinet 12. Therefore, it is necessary to provide a water connection and suitable electrical connections between the dispensing unit 24 and the main cabinet 12.

A tube 36 extends downwardly through the freezer door 18 from a point adjacent the dispensing apparatus 24 to the bottom of the door 18. The tube 36 carries a water tube 37 and a plurality of electrical conductors 39, see FIG. 4, which are connected as necessary to the dispensing apparatus 24. Insulation (not shown) is included in the door 18 for preventing freeze-up of water in the water tube 37.

Figure 3:
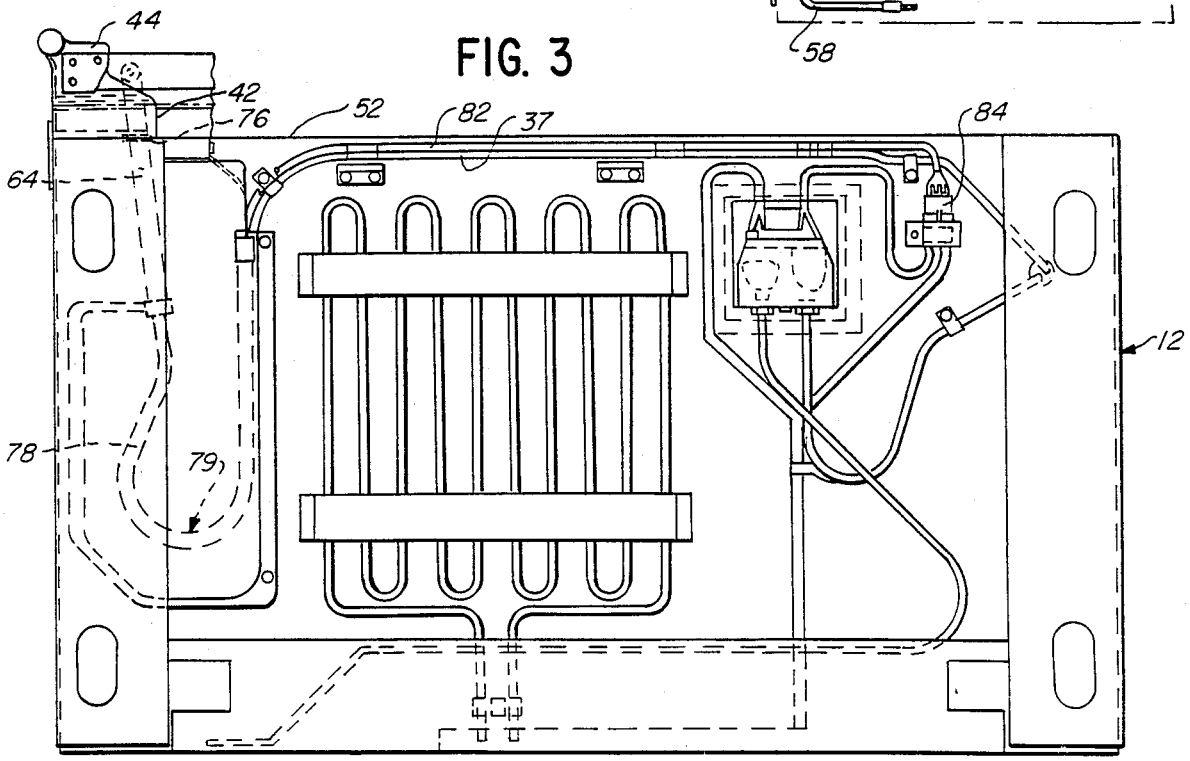
FIG. 3 is a partially cut away bottom view of the refrigerator of FIG. 1.

Referring also to FIGS. 3–5, a crossover tube assembly 38 is provided for routing the water tube 37 and conductors 39 from the door 18 to the cabinet 12.

The bottom of the door 18 is hingedly mounted to the cabinet 12 using a hinge assembly 40. The hinge assembly 40 includes hinge butt 42 and a hinge leaf 44. The hinge butt 42 may be, for example, of chrome plated steel single piece construction and is generally L-shaped. The hinge butt 42 includes a planar fastening section 46 turned to an outwardly extending planar support section 48. The fastening section 46 includes suitable apertures through which fastening elements 50 extend for fastening the hinge butt 42 to a base portion 52 of the cabinet 12.

The hinge leaf 44 is a generally planar plate preferably of chrome plated metal construction. The hinge leaf 44 is fastened to the underside of the door 18 in any known manner. A pivot pin 54 is secured to the hinge butt planar section and extends upwardly through a pivot opening in the hinge leaf 44. A generally similar hinge is provided at the top portion of the freezer door 18. Thus, the freezer door 18 is pivotally movable about an axis represented by the dashed line 56. According to the disclosed embodiment the pivot axis is outside of the cross section of the door 18.

The crossover tube assembly 38 provides a conduit from the door 18 into the cabinet base 52 remote from the hinge pivot axis. Particularly, since the pivot axis does not lie within the door the hinge assembly 40 cannot be used to route the connection elements as was done with prior refrigerators. The crossover tube assembly 38 thus provides a means for routing water and electrical lines between the cabinet 12 and the door 18 so that the entry into the door 18 is at a place other than the hinge pivot axis.

The crossover tube assembly 38 includes a rigid tube 58. The tube 58 is turned to an L-shape configuration and includes a short leg portion 60 terminating in a flanged or flared end 62, and a relatively longer leg portion 64. A fitting 66 is provided for pivotally connecting the tube 58 to the door 18. Specifically, the fitting 66 includes a retaining nut 68 which has a relatively narrow bore opening, for receiving the tube 36, connecting a larger, coaxial threaded opening. The retaining nut 68 is assembled to the door and is secured therein in any known manner. For example, if the door is foamed in place, the retaining nut may be secured in place by the hardening of the foam.

A torque nut 70 extends over the lower leg portion 60 of the tube 58. The torque nut 70 is threaded through an opening 72 in the bottom of the door into the retaining nut 68. Thus, the crossover tube 58 is held in place by the flared end 62 being of a larger diameter than the inner diameter of the torque nut. The outer diameter of the tube 58 is slightly less than the inner diameter of the torque nut 70, so that the tube 58 is freely rotatable therein.

The long leg portion 64 of the tube 58 extends through an opening 74 in the cabinet base 52. A grommet 76 is secured about the opening 74 and facilitates slidable movement of the leg portion 64 therethrough.

Referring specifically to FIG. 3, the crossover tube long leg portion 64 extends into the cabinet base 52 and has an inner end which is adhered to a braided scuff jacket 78. The jacket 78 includes a slack loop portion 79 to protect the the water tube 37 and the electrical conductors 39 as they move with the door. The water tube 37 passes through the jacket 78 and is connected to a suitable source of water in the cabinet 12, as is well known. A second tube or conduit 82 is connected to the other end of the jacket 78. The conduit 82 carries the conductors 39 for connecting via a terminal plug 84 to electrical circuits (not shown) within the cabinet 12.

With reference also to FIG. 6, it can be seen schematically that when the door 18 is in the closed position, illustrated in solid line, the tube long leg portion 64 is generally perpendicular to the door and extends rearwardly through the grommet 76. As the door 18 is moved to the open position, illustrated in dashed lines, the crossover tube 58 pivots as by the short leg portion 60 pivoting within the torque nut 70, and the long leg portion 64 sliding outwardly through the grommet 76. The tube 58 is shaped to enter the cabinet at the desired location and the long leg portion 64 is sufficiently long to ensure that it is not pulled out of the grommet 76 when the door 18 is at any of its normal functioning positions. Also, the grommet 76 includes a central opening large enough to permit entry of the tube 58 at various angles.

Referring to FIG. 7, a crossover tube assembly 90 according to an alternative embodiment of the invention is illustrated. The crossover tube assembly 90 includes a rigid tube 92 molded with external threads 94 on a short leg portion 96. The short leg portion 96 is connected through a turned portion 98 to a long leg portion 100.

A retaining nut 102 is foamed in the door 18 and includes an open end 104 extending into the door tube 36 and a threaded end 106 for receiving the crossover tube threads 94.

After foaming of the door 18, the crossover tube 92 is screwed into the door assembly as shown, and the long leg portion 100 of the tube is inserted through the grommeted hole 74 in the base of the refrigerator, as discussed above. The opening and closing of the door 18 tightens and untightens the connection between the crossover tube threads 94 and the retaining nut threaded end 106, to pivot the tube 92, but the amount of rotation incurred is not enough to allow the tube 92 to tighten completely or to loosen and dislodge.

The use of the threaded crossover tube results in the elimination of the torque nut 70, see FIGS. 4 and 5, and also allows the crossover tube to be of a larger diameter to carry additional wires. Specifically, the outer diameter of the crossover tube 92 is limited by the inner diameter of the nut 102. Conversely, with the embodiment of FIGS. 3-6, the torque nut must first be threaded into the retaining nut 68, thereby limiting the available diameter for the crossover tube 58.

Thus, the invention broadly comprehends a crossover tube pivotally mounted to a refrigerator cabinet door for routing utility lines, such as a water tube and electrical conductors, between a dispensing apparatus on the door and a source apparatus in the cabinet.

The foregoing disclosure of the exemplary embodiments is illustrative of the broad inventive concepts comprehended by the invention.

I claim:

1. In a refrigeration apparatus including a cabinet housing a utility source apparatus, a door hingedly mounted to said cabinet and having a utility utilization apparatus, and means for operatively connecting said utilization apparatus to said source apparatus, the improvement comprising:

means pivotally mounted to said door and extending into an opening in said cabinet for routing said connecting means from said door to said cabinet.

2. The improvement of claim 1 wherein said routing means comprises a rigid tube.

3. The improvement of claim 1 wherein said routing means comprise a tube threadably mounted to said door.

4. The improvement of claim 1 wherein said routing means comprises a tube slidable received in an opening in said cabinet.

5. In a refrigeration apparatus including a cabinet and a door hingedly mounted to said cabinet, the door including a dispensing apparatus connected to a control apparatus housed in said cabinet by a plurality of conducting elements, the improvement comprising:

a conduit slidably received in an opening in said cabinet; and means for pivotally mounting said conduit to said door, wherein said conduit carries said conducting elements from said door to said cabinet.

6. The improvement of claim 5 wherein said conduit comprises a rigid tube.

7. The improvement of claim 5 wherein said mounting means comprises a threaded connector fastened to said door and said conduit comprise a threaded tube threadably engaged with said connector.

8. The improvement of claim 5 wherein said mounting means comprises a retaining nut fastened to said door and said conduit comprise a tube having a flange at one end pivotally received in said retaining nut.

9. The improvement of claim 5 further comprising a grommet mounted to said cabinet at said opening to facilitate sliding movement of said conduit.

10. A refrigeration apparatus construction, comprising:

a cabinet housing an ice making apparatus, a source of refrigerated liquid, and an electrical control circuit;

a door hingedly mounted to said cabinet, the door including an electrically controlled ice and liquid dispensing apparatus positioned proximate said ice making apparatus;

a liquid conduit connecting said dispensing apparatus to said liquid source;

a plurality of electrical conductors connecting said dispensing apparatus to said electrical control circuit;

a crossover tube slidably received in an opening in said cabinet; and means for pivotally mounting said tube to said door, wherein said tube carries said liquid conduit and said conductors from said door to said cabinet.

11. The refrigeration apparatus of claim 10 wherein said tube comprises a rigid tube.

12. The improvement of claim 10 wherein said mounting means comprises a threaded connector fastened to said door and said tube comprise a threaded tube threadably engaged with said connector.

13. The improvement of claim 10 wherein said mounting means comprises a retaining nut fastened to said door and said tube includes a flange at one end pivotally received in said retaining nut.

14. The improvement of claim 10 further comprising a grommet mounted to said cabinet at said opening to facilitate sliding movement of said tube.

* * * * *